US008549662B2

(12) United States Patent
Chang

(10) Patent No.: US 8,549,662 B2
(45) Date of Patent: Oct. 8, 2013

(54) PROTECTIVE GEAR

(75) Inventor: Rong Chen Chang, Beverly Hills, CA (US)

(73) Assignee: Wrong Gear, Inc., Beverly Hills, CA (US)

( * ) Notice: Subject to any disclaimer, the term of this patent is extended or adjusted under 35 U.S.C. 154(b) by 0 days.

(21) Appl. No.: 13/453,953

(22) Filed: Apr. 23, 2012

(65) Prior Publication Data

US 2012/0204326 A1 Aug. 16, 2012

Related U.S. Application Data

(63) Continuation of application No. 12/560,367, filed on Sep. 15, 2009, now Pat. No. 8,185,969.

(51) Int. Cl.
*A41D 13/00* (2006.01)

(52) U.S. Cl.
USPC ..... 2/9; 2/206; 2/425

(58) Field of Classification Search
USPC ..... 2/9, 202, 206, 207, 425; 128/201.22, 128/201.23, 201.25, 206.19, 206.21, 207
See application file for complete search history.

(56) References Cited

U.S. PATENT DOCUMENTS

| | | | | |
|---|---|---|---|---|
| 766,963 | A | | 8/1904 | Murray |
| 4,017,906 | A | | 4/1977 | Bochynsky et al. |
| 4,236,257 | A | | 12/1980 | Williams et al. |
| 4,250,577 | A | | 2/1981 | Smith |
| 4,300,240 | A | | 11/1981 | Edwards |
| 4,608,298 | A | | 8/1986 | Klaff |
| 5,035,006 | A | | 7/1991 | Hetz et al. |
| 5,058,211 | A | | 10/1991 | Hanks |
| 5,471,683 | A | * | 12/1995 | Moretz et al. ..... 2/181 |
| 5,485,836 | A | | 1/1996 | Lincoln |
| D369,442 | S | | 4/1996 | Jones |
| 5,513,392 | A | * | 5/1996 | Douglas et al. ..... 2/207 |
| 5,575,009 | A | | 11/1996 | Ryvin |
| 5,685,016 | A | | 11/1997 | Douglas |
| 5,822,800 | A | | 10/1998 | Anderson |
| 5,845,340 | A | | 12/1998 | Frislie |
| 6,032,292 | A | | 3/2000 | Wood et al. |
| 6,279,572 | B1 | | 8/2001 | Danisch et al. |
| 6,338,340 | B1 | | 1/2002 | Finch et al. |
| 6,665,878 | B1 | | 12/2003 | Way |
| 6,848,122 | B1 | | 2/2005 | Meeds |

(Continued)

OTHER PUBLICATIONS

PCT, International Search Report, Mar. 9, 2011.

(Continued)

*Primary Examiner* — Katherine Moran
(74) *Attorney, Agent, or Firm* — WHGC, PLC; John F. O'Rourke

(57) ABSTRACT

A protective head gear for a user having an outer panel, an inner panel, a retention pleat on the inner panel, a respirator, and an indexed fastener. The outer panel is disposed relative to the inner panel to provide efficacious spatial separation therebetween. The fastener is formed to adjustably and releasably secure at least a portion of the inner panel to the user. An indexing element is attached to the fastener, and is formed of material substantially tactilely different from the fastener, the outer panel, or the inner panel, to permit the user to unambiguously locate the point of fastening. The outer panel, inner panel, and respirator, can be composed of fabrics having one or more layer, and one layer can have a repellent characteristic different from another (e.g., hydrophobic vs. hydrophilic).

8 Claims, 5 Drawing Sheets

(56) References Cited

U.S. PATENT DOCUMENTS

| | | | |
|---|---|---|---|
| 6,888,950 | B2 | 5/2005 | Siskin et al. |
| 6,928,657 | B2 | 8/2005 | Bell et al. |
| 7,028,345 | B2 | 4/2006 | Waldman |
| 7,076,811 | B2 | 7/2006 | Puchalski |
| 7,096,511 | B2 | 8/2006 | Cohen |
| 7,117,543 | B1 | 10/2006 | Gunnarshaug |
| 7,152,252 | B2 | 12/2006 | Gellis et al. |
| 7,168,095 | B2 | 1/2007 | Wright |
| 7,228,858 | B2 | 6/2007 | Baker |
| 7,275,269 | B2 * | 10/2007 | Skillman ..... 2/207 |
| 7,350,241 | B2 | 4/2008 | Gendall |
| 2004/0078869 | A1 | 4/2004 | Bell et al. |
| 2005/0120452 | A1 | 6/2005 | Cominsky |
| 2005/0160514 | A1 | 7/2005 | Flaniken |

OTHER PUBLICATIONS

PCT, Written Opinion of the International Search Authority, Mar. 9, 2011.

* cited by examiner

PROTECTIVE GEAR

This Application is a Continuation of U.S. application Ser. No. 12/560,367 U.S. Pat. No. 8,185,969, entitled "Protective Gear," filed on Sep. 15, 2009, and issued on May 29, 2012.

FIELD OF THE INVENTION

The present invention is generally related to an article of clothing or garment, and, more particularly, to a garment which may be used to cover and protect a user's head, neck, and adjacent regions.

BACKGROUND ART

Scarves, bandannas, keffiyehs, and shemaghs (collectively, head gear) have long been used to protect the head and face of the wearer from heat, cold, wind, precipitation, mud, sand, and dust. Often head gear is provided as a large square, which is folded, wrapped, or twisted around the user to provide protection, visibility, and ease of use. One popular style of wearing such head gear includes folding the large square into a triangle, which facilitates wrapping the head gear around the user's face and head. In general, the head gear can be secured to the user's head by tying and knotting together two triangle ends, employing varying degrees of snugness in hopes of a correct, secure, and lasting tie-off.

In addition, existing head gear can be made of natural, primarily hydrophilic fibers, such as cotton, which while often comfortable, can become saturated with water, including the breath of the user. Natural fabrics also can stretch, lose shape, and be susceptible to slipping off of the user's face unless frequently re-knotted. Other often used fibers also may tend to stretch or become misshapen, so that the head gear secured around the user's face may become inconveniently misaligned or may slip off the user's nose and face. Therefore, typical head gear tend to be ill-suited for active individuals, such as athletes, dancers, off-road vehicle riders, extreme sports enthusiasts, soldiers, or open-range cattle management personnel.

SUMMARY

Non-exclusive, non-limiting embodiments of the invention illustrated herein provide a protective head gear for a user, which includes an outer panel having an outer obverse side, an outer reverse side, an outer base and an outer apex generally perpendicular to the base. The protective head gear also has an inner panel including an inner obverse side, an inner reverse side, an inner base and, an inner apex generally perpendicular to the inner base. In certain embodiments a portion of the outer base of the outer panel is at least partly attached to a corresponding portion of the inner base of the inner panel. In embodiments, an efficacious spatial gap is formed when the portion of the outer base of the outer panel is at least partly attached to a corresponding portion of the inner base of the inner panel. Typically, a portion of the outer reverse side is proximate to a portion of the inner obverse side, with a spatial separation being disposed between the outer reverse side and the inner obverse side. A retention pleat is formed, to retain a portion of the user, in the inner panel at least in proximity with the inner base midpoint, and positioned approximately distally to, and in parallel with the inner apex. In general, a fastener is attached to at least one end of the outer panel, the inner panel, or both. The fastener is formed to adjustably and releasably secure at least a portion of the inner panel to the user. In some embodiments, the protective head gear further includes a respirator panel attached to an upper portion of the reverse side of the inner panel, approximately rearward of the retention pleat and approximately midpoint along the inner panel. Alternatively, some embodiments of the protective head gear further include an indexing device affixed to an end of the obverse side of the outer panel. The indexing device is indexingly and removably affixed to a portion of the fastener. In selected protective head gear embodiments with the respirator, an indexing device affixed to an end of the obverse side of the outer panel, with the indexing device being indexingly and removably affixed to a portion of the fastener. The respirator panel of the protective head gear further can include a perforated cloth having an at least partly hydrophobic absorption characteristic. Also, in selected embodiments, the obverse side of the outer panel of the protective head gear further includes an at least partly hydrophobic absorption characteristic.

Other non-exclusive, non-limiting embodiments of the invention illustrated in the form of a protective head gear for a user, include an outer panel having an outer obverse side, an outer reverse side, a outer base, and an outer apex generally perpendicular to the base. The gear also can include an inner panel having an inner obverse side, an inner reverse side, an inner base and an inner apex generally perpendicular to the inner base. Typically, a portion of the outer base of the outer panel is at least partly attached to a corresponding portion of the inner base of the inner panel, and an efficacious spatial gap is formed when the portion of the outer base of the outer panel is at least partly attached to a corresponding portion of the inner base of the inner panel. Moreover, a portion of the outer reverse side is proximate to a portion of the inner obverse side, and a spatial separation is disposed between the outer reverse side and the inner obverse side. In these embodiments, a retention pleat, to retain a portion of the user within the gear, is formed in the inner panel at least in proximity with the inner base midpoint and positioned approximately distally to and in parallel with the inner apex. In addition, a fastener is attached to at least one end of one or both of the outer panel and the inner panel; and the fastener is formed to adjustably and releasably secure at least a portion of the inner panel to the user. These example embodiments have a respirator panel attached to an upper portion of the reverse side of the inner panel, approximately rearward of the retention pleat and approximately midpoint along the inner panel. An indexing device is affixed to an end of the obverse side of the outer panel, and the indexing device is indexingly and removably affixed to a portion of the fastener.

BRIEF DESCRIPTION OF THE DRAWINGS

The present invention is illustrated by way of example and not by limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE EMBODIMENTS

Figure 1:
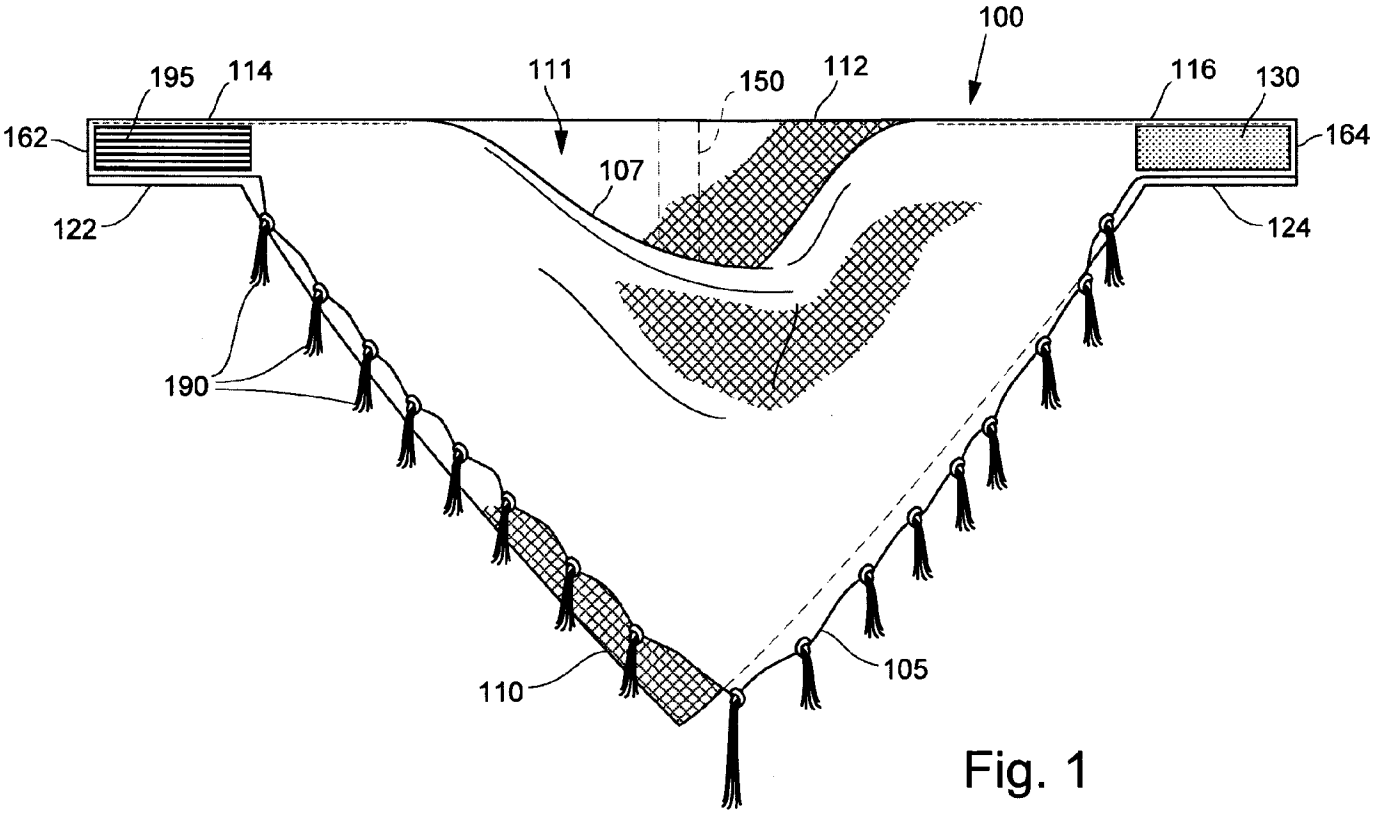
FIG. 1 is an illustration of a front view of an embodiment of protective gear 100 in accordance with the teaching of the invention herein.

FIG. 1 illustrates a front plan view of an embodiment of gear 100. FIG. 3A illustrates a front view of an embodiment of gear 100, as maybe worn by user 101. Regarding FIG. 1 and FIG. 3, protective gear 100, which can be in accordance with present embodiments may include, without limitation, outer panel 105, inner panel 110, and respirator panel 125 (shown in FIG. 2). In general, one or more of outer panel 105, inner panel 110, and respirator panel 125 may be constituted of natural, man-made or manufactured material, or a composite thereof, may be plain or treated material, may be woven or non-woven cloth, and may be constituted of a hydrophobic material, a hydrophilic material, or a hygroscopic material or may be a functional combination of two or more layers of hydrophobic, hydrophilic, or hygroscopic materials. One or both of panels 105, 110 may be a sized portion of cloth, which may be unilayer cloth or multilayer cloth, and may be generally soft and flexible. Of course, additional panels other than 105, 110 may be used to form gear 100. Although panels 105, 110 may be of a similar shape and size, it is contemplated that panels 105, 100, as well as additional panels, if any, may be of different size and shape. Panels 105, 110 may be joined, at least in part, by sewing, by use of a fusible bonding agent, or by both.

Current head gear commonly in use may formed from a single, folded panel of fabric, in which one fold may hang closely to an adjacent fold of fabric, and which may not provide an efficacious spatial gap between adjacent layers. Gear 100 may be fabricated of two or more panels of fabric, which may be selectively attached to form at least one efficacious spatial gap 111 between two of the two or more panels of fabric. In some embodiments, efficacious spatial gap 111 can be accomplished by providing a front panel 105, which may be partially attached to rear panel 110, and may hang loosely from rear panel 110. An efficacious air gap can be formed by providing standoffs to at least one panel, so that their effect may facilitate air gap efficacy. In certain embodiments, an efficacious air gap can be provided by a panel that drapes loosely relative to a rearward panel and that may include standoffs 190, for example, along at least a portion of the periphery of front panel 105.

Panel 110 also may exhibit some hydrophilic characteristics, further contributing to the comfort of user 101 by moderating ambient nuisances as it reduces the moisture trapped within panel 110 against the face of user 101. Panel 105 may be provided with hydrophobic characteristics, for example, to afford ambient moisture protection to user 101, although some embodiments may not employ such a characteristic.

A spatial gap between inner panel 110 and outer panel 105 may provide insulative or filtering functions, or both, between the exterior of outer panel 105 and the interior of inner panel 110. As a result, protective gear may be useful for use in outdoor activities, where inhalation of dust, dirt, snow, ice, rain, or hot or cold air, can be mitigated. Protective gear 100 may be worn by user 101, alone, or in combination with one or more other garments, such as jacket 165, goggles 170, and helmet 180.

One or both of outer panel 105 and inner panel 110 can be shaped having a generally triangular form, including panel base 107, 112, respectively, with two panel sides extending from the panel base to a panel apex. Typically, a reverse surface of outer panel 105 can be proximate to the obverse surface of inner panel 110. Gear 100 can be configured such that inner panel 110 may be placed adjacent to a portion of the head of user 101, which may include the face. For example, inner panel 110 may be sized and shaped to be circumferentially disposed on the head of user 101. In general, inner panel 110 may be sized between about one foot to about three feet along inner base 112, with an example size being about two feet (about 60 cm.), as measured along inner base 112. In addition, inner panel 110 may be sized between about one-half foot to about three feet, as measured from inner base 112 to inner apex 114, with an example size being about one foot (about 30 cm).

Dimensions of outer panel 105 may be similar to dimensions of inner panel 110, or may be different. In some embodiments, outer panel 110 can have dimensions that may be up to 50% different from those of inner panel 110, with the difference being larger or smaller. Outer panel 105 can be detachably, or permanently, attached to inner panel 110, at least in part. Also, outer base 107 of outer panel 105 may be attached in part, or in whole, with inner base 112 of inner panel 110. In certain embodiments, at least one portion of outer base 107 can be attached to at least one portion of inner base 112. For example, predetermined portions of ends of outer base 107 may be affixed near predetermined sections of ends of inner base 112, with at least a portion of base outer base 107 being unattached to inner base 112, producing a layered, draped appearance to gear 100, as illustrated. In general, outer panel 105 of selected embodiments of gear 100 can be disposed loosely and at least partially apart from inner panel 110. Inner panel 110 may be formed to allow at least a portion of inner base 112 to become proximate to, or covered by, goggles 170; with corresponding outer panel 105 being formed to drape beneath goggles 170, as illustrated in FIG. 3.

Typically, retention pleat 150 can be disposed near the approximate midpoint of inner base 112, and can be sized and shaped to at least partly and releasably retain a portion of user 101, for example, user nose 102. Retention pleat 150 can be a single pleat, a double pleat, or any other suitable gather; a pucker; an overlap; a pocket; a bulge; a bend; a crease; a crimp; a flexure; a fold; a plication; a tuck; or a functionally similar material fold. Retention pleat 150 may be formed on inner panel 110 for example, by stitching, by pre-stressing, by thermoforming, or by applying a fusible bonding agent or flexible bonding agent, suitable for producing a soft, generally non-obtrusive retention pleat 150. A fusible bonding agent may include, without limitation, a fusible web, interlining, fabric, yarn, thread, liquid, foam, resin, film, or powder, which may include one or more of polyethylene, polyethylene copolymers, polypropylene, polyester, or polyamide. In some embodiments, retention pleat 150 may be formed or augmented by an elastic or deformable portion, for example, using shaped foam, elastic fabric, or a formed plastic or metallic stay.

In general, though, a soft, pliant retention pleat 150 in the form of a simple pleat can suffice, and may minimize injury, which may occur from a vigorous or even forceful thrust of retention pleat 150 against a proximate portion of the body of user 101. As shown in FIG. 3, retention pleat 150 having soft, pliant characteristics may assist with gear 100 being held in place proximate to goggles 170 and on the face of user 101, without being displaced during active use by a movement of goggles 170. Panels lacking retention pleat 150 tend to create a gap on one or both sides of an extended portion of a user 101, for example, on one or both sides of user's nose. Such panels tend to slip, or be pulled from, an intended position on the user. Retention pleat 150 may be applied, for example, to inner panel 110, as described by the teachings herein, so that at least panel 110 may generally be retained in position on the user, despite tugging, pulling, or torsioning of gear 100, inner panel 110, or both.

In general, outer panel 105 may include first outer tab extension 114 on an outer base 107 first end and second outer tab extension 116 on an outer base 107 second end. Similarly, inner panel 110 may include first inner tab extension 122 on an inner base 112 first end and second inner tab extension 124 on an inner base 112 second end. At least a portion of first outer tab extension 162 may be affixed to at least a portion of first inner tab extension 122, and at least a portion of second outer tab extension 164 may be affixed to at least a portion of second inner tab extension 124.

Indexing device 195 may be disposed on the obverse of outer panel 105 approximately at an end of outer base 107. First fastener element 130 generally is disposed generally opposite indexing element 195, and generally at another end on the obverse side of panel 105. For example, indexing element 195 may be affixed to first outer tab extension 162 and first fastener element 130 may be affixed to second outer tab extension 164. Of course, an opposite orientation also could be provided.

For simplicity, a two-element fastener is depicted as being used with gear 100, although a fastener used with gear 100 is not so limited. A non-limiting example of a two-element fastener, which may be used with gear 100, includes a hook-and-loop type fastener, with a loop portion generally corresponding to fastener element 131 (not shown) and a hook portion generally corresponding to corresponding to fastener element 130. In embodiments with fabric hook-and-loop fasteners, fastener tabs 130, 131 are disposed to adjustably overlap, so that user 101 (not shown) may comfortably and removably don gear 100. Alternatively, fastener 130, 131 may be, without limitation, a button- (or stud-) and -eyelet closure, a hook-and-eye closure, a snap closure, a tie closure, a toggle, or a clasp closure. However, as noted relative to retention pleat 150, use of a generally soft, pliant, and secure yet easy-to-remove closure may minimize injury which may occur from a vigorous or even forceful thrust of fastener 130, 131 against a proximate portion of the body of user 101.

Indexing device 195 may be constituted of a firm, flexible material, such as a leather, a rubber, or a plastic material, which may be perceived through user gloves (not shown). Indexing device 195 may facilitate placement or adjustment of gear 100 on user 101, as well as provide user 101 with perceptible indicia by which fastener elements 130, 131 may quickly be undone or adjusted in relative position, or that gear 100 may rapidly be removed from user 101.

Second fastener element 131 generally is disposed on the reverse of a portion of gear 100, substantially adjacent and rearward to indexing element 195. For example, in a configuration where indexing element 195 is disposed on the obverse side and affixed to first outer tab extension 114, at least a portion of second fastener element 131 may be affixed to first inner tab extension 118. The general configuration of embodiments having these features can include gear 100 being wrapped around the head of user 101, and aligned so that at least a portion of first fastener element 130 is releasably affixed to at least a portion of second fastener element 131.

Figure 2:
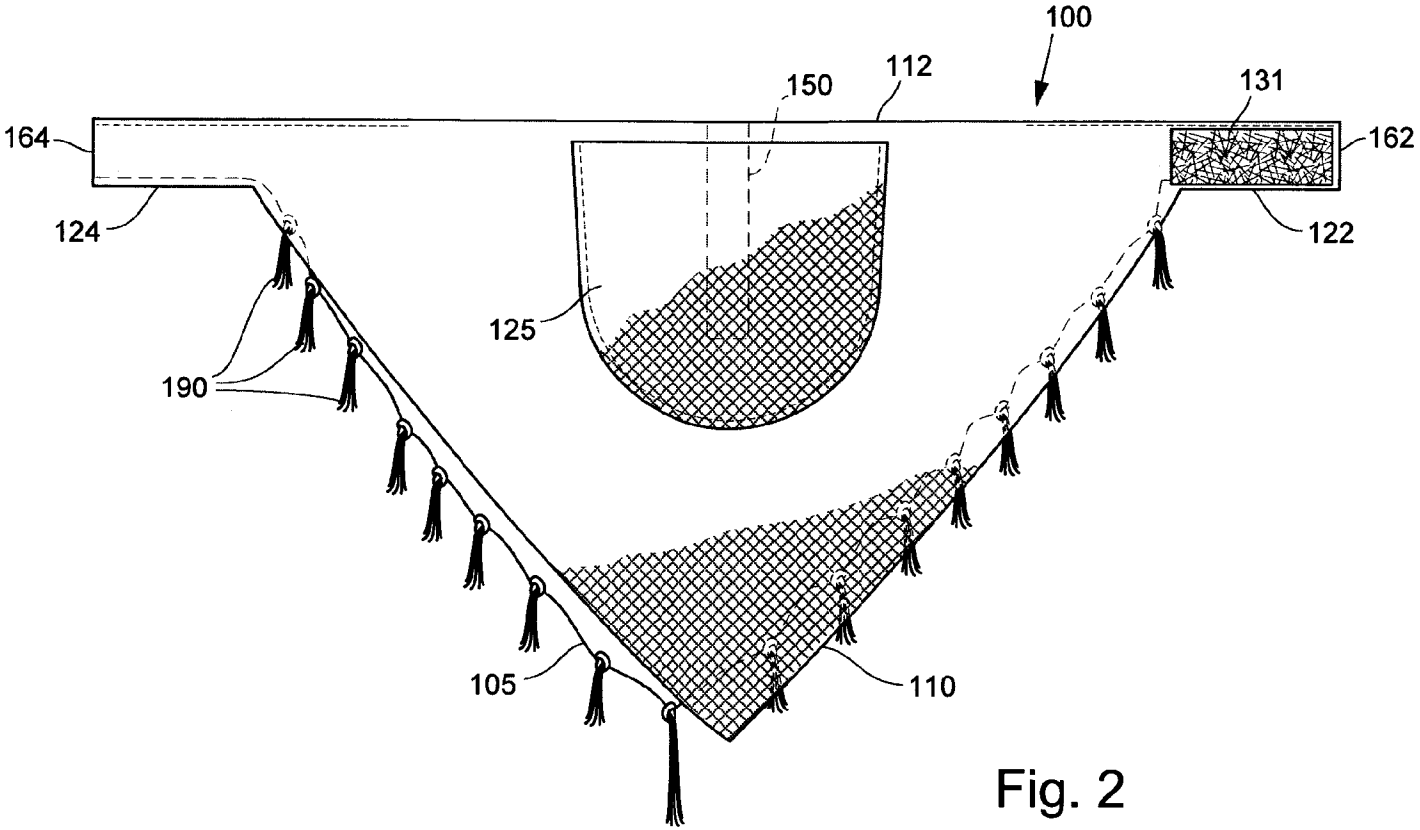
FIG. 2 is an illustration of a rear view of an embodiment of protective gear 100 in accordance with the teaching of the invention herein.
Figure 3:
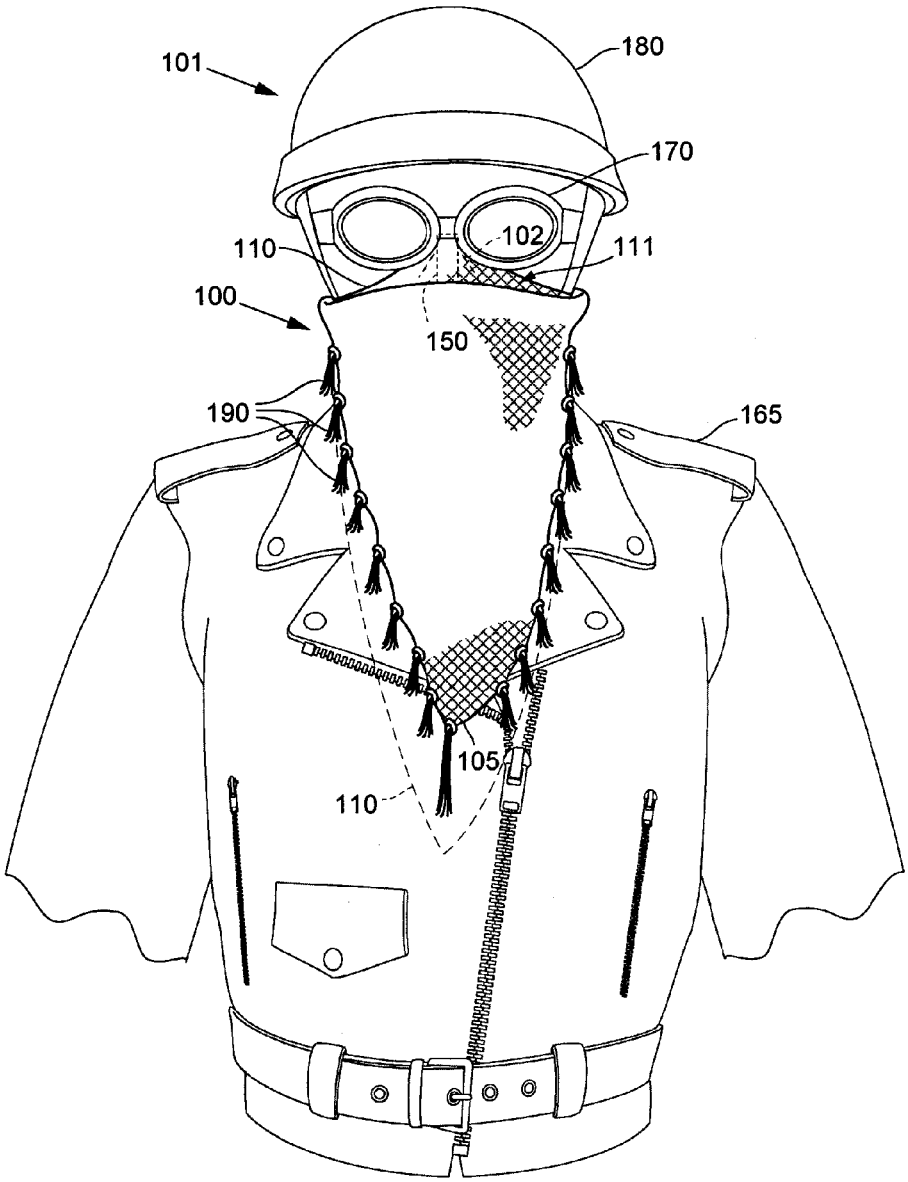
FIG. 3 is an illustration of a front view of an embodiment of protective gear in accordance with the teaching of the invention herein, as may be disposed on a user.

Turning to FIG. 2, a plan view of inner panel 110 of the reverse side of gear 100 is depicted. Inner panel 110 includes first tab extension 122 on an inner base first end and a second tab extension 124 on an inner base second end. Each of tab extensions 122, 124 extend horizontally from respective portions of inner base 112. In selected embodiments, a portion of outer base 107 of outer panel 105 is at least partly attached to a corresponding portion of inner base 112 of inner panel 110. Second tab extension 164, which may be disposed on one end of inner base 112, may be attached to form a common first tab extension 162 with first outer tab extension 114 on outer base 107 and, similarly, second inner tab extension 122 on a substantially other end of inner base 112 forms a common second tab extension 164 with second outer tab extension 116 of outer base 107. Outer panel 105 may be attached to inner panel 110 to create a spatial separation between the reverse side of outer panel 105 and the obverse side of inner panel 110.

One or more of indexing element 195, first fastener element 130, or second fastener element 131 also may be affixed to a respective one of a common tab extension. For example, indexing element 195 may be affixed to the obverse side of common first tab extension 162; second fastener element 131 may be affixed to the reverse side of common first tab extension 162; and first fastener element 130 may be affixed to the obverse side of common second tab extension 164.

The material of respirator panel 125 may be woven, non-woven, knitted, or perforated, at least in part. Typically, respirator panel 125 may be provided as fabric having a capability of wicking moisture away from the immediate area of contact with user 101. In one non-limiting example, respirator panel 125 may be constituted of 100% polyester open mesh jersey cloth, which may be at least partially hydrophobic. A respirator panel 125 constituted of 100% ventilated polyester mesh material on the face/mouth area for comfort and may help to prevent expired moisture from fogging goggles 170. However, perforated, porous, or open-weave cloth other than open mesh jersey cloth also may be used effectively. Panel 125 may be provided as a U-shaped portion of material having a width of between about two inches to about eight inches wide, and a height of between about two inches to about eight inches high. Respirator panel 125 may be attached, in part or in whole, by sewing, by fusible fabric bonding, or by both. In FIG. 2, "width" can be a dimension measured generally parallel to base 112, and "height" can be a dimension measured generally perpendicular to "width. A typical respirator panel 125 may be about five inches wide and about five inches high, although other dimensions and configurations certainly are within the scope of the present teachings. Panel 125 can be disposed near the approximate midpoint of inner base 112, adjacent to retention pleat 150. Panel 125 can be sewn, bonded, or welded to an inner surface of inner panel 110. An air gap or pocket may form between panel 125 and panel 110 and, by extension, between a portion of user 101 in proximity with panel 125. Such an air gap may provide respite from ambient environmental conditions, including wind, rain, snow, ice, cold, sand, dust, or heat.

Panel 110 may have a greater fabric density, or thickness, than panel 105. Panel 110 also may be configured to have longer sides than panel 105, and be capable of being tucked inside of another garment worn by user 101, such as, without limitation, a jacket, a shirt, a duster, or a pullover top.

In an alternative embodiment, a rough-duty face shield 100 for a user having a preselected user body portion (not shown) is disclosed, including a open outer layer 105 composed of a first fabric having a generally large-pore (less dense) construction, wherein the open outer layer 105 remains efficaciously tight in construction to trap or repel or both particulate matter from intruding from an environment around the user; a tight inner layer 110 composed of a second fabric having a generally narrow pore (more dense) construction, wherein the inner layer 110 is constructed to remains capable of permitting an efficacious air flow to the user between the obverse side of the inner layer 110 and the reverse side of the inner layer 110, irrespective of a partial obstruction of the fabric openness and wherein a portion of the outer layer 105 is affixed to drape over a portion of the inner layer 110, thereby forming a spatial separation between the inner layer 110 and the outer layer 105; a retention pocket 150 formed into the inner layer 110, generally coinciding with a preselected user body portion (not shown), formed to be resiliently and releasably retained on the preselected user body portion (not shown) during use; a respirator panel 125 formed of a third fabric on a reverse side of the inner layer 110 generally proximate to the preselected user body portion (not shown) composed of a soft fabric having a generally wide-pore construction, wherein fabric holes of the wide-pore construction are substantially larger than fabric holes of the large-pore construction, and holes of large-pore construction are substantially larger than fabric holes of the narrow-pore construction; and an indexed fastener, including a fastener portion attached to one or both base ends of one or both of the inner panel or the outer panel, and an indexing portion attached to a portion of the fastener portion, positioned to identify to the user the location of the fastener portion, relative to other portions of the shield, and formed of a material markedly more firm than the outer layer 105, the inner layer 110, and the respirator panel 125 by which a shield user can unambiguously discern the location of the indexing portion. At least one of the open outer layer 105, the tight inner layer 110, the retention pocket 150, or the respirator panel 125 can be formed from a multilayer fabric. In embodiments, at least a portion of one of the open outer layer 105, the tight inner layer 110, the retention pocket 150, or the respirator panel 125, is formed from a fabric having a repellent characteristic with respect to a predetermined solvent, which may be water. At least a portion of the respirator panel 125 may have a hydrophobic repellent characteristic. The face shield 100 also may include a plurality of standoffs 190 selectively disposed around the periphery of the outer layer 105 and at least partially positioned between the inner layer 110 and the outer layer 105 forming a spatial separation therebetween, wherein the inner layer 110 is formed with a surface area at least 25% larger than the outer layer 110.

A plurality of standoffs, generally at 190, may be disposed on one or more vertically-inclined edges of panel 105, which depend from base 107, and may assist in preserving at least partial spatial separation between outer panel 105 and inner panel 110. Standoff 190 may be formed generally along outer base 107 by sizing outer panel 105 to drape or fold generally parallel to inner base 112. Spatial separation may facilitate at least some air entrapment between panels 105 and 110, may prevent panel 105 from lying flat against panel 110, and may enhance the effects of respired air warming, airborne particle filtration, or air moisture management, which may be desirable in harsh environments. For example, exhaled air may warm panels 105 and 110 under cold ambient conditions, so that inhaled air may be warmed during inhalation. At the same time, the at least partial spatial separation between panels 105 and 110 tends to inhibit condensation of moisture on outer panel 105, proximal to the nose and mouth, increasing comfort to the user. A cooling effect similarly may be produced in hot environments, for example, by providing a zone for expired moisture to evaporate and to moderate the temperature and humidity of inhaled air. In addition, inhaled air particulate can be filtered out of incoming air by one or both of panels 105 and 110, with standoffs 190 permitting an alternate path for air flow through panel 110 should the fabric pores of panel 105 become clogged, for example, with dust.

Standoffs 190 can be formed from gathered threads from panel 105 edges, which may be knotted to fashion a standoff body of sufficient dimension to produce the desired standoff effect between panels 105 and 110. Alternately, standoffs 190 may be portions of string, yarn, leather, plastic, or other material capable of hanging generally freely and pendently from the respective point of attachment on panel 105. Standoffs 190 also may include bodies having one or more ornamental beads, baubles, adornments, or trinketry, along with, or in place of knotted gathered threads, although embodiments of gear 100 may use generally soft, pliant material for standoffs 190, for example, to minimize injury which may occur from a vigorous or even forceful thrust of standoffs 190 against a proximate portion of the body of user 101.

Figure 4A:
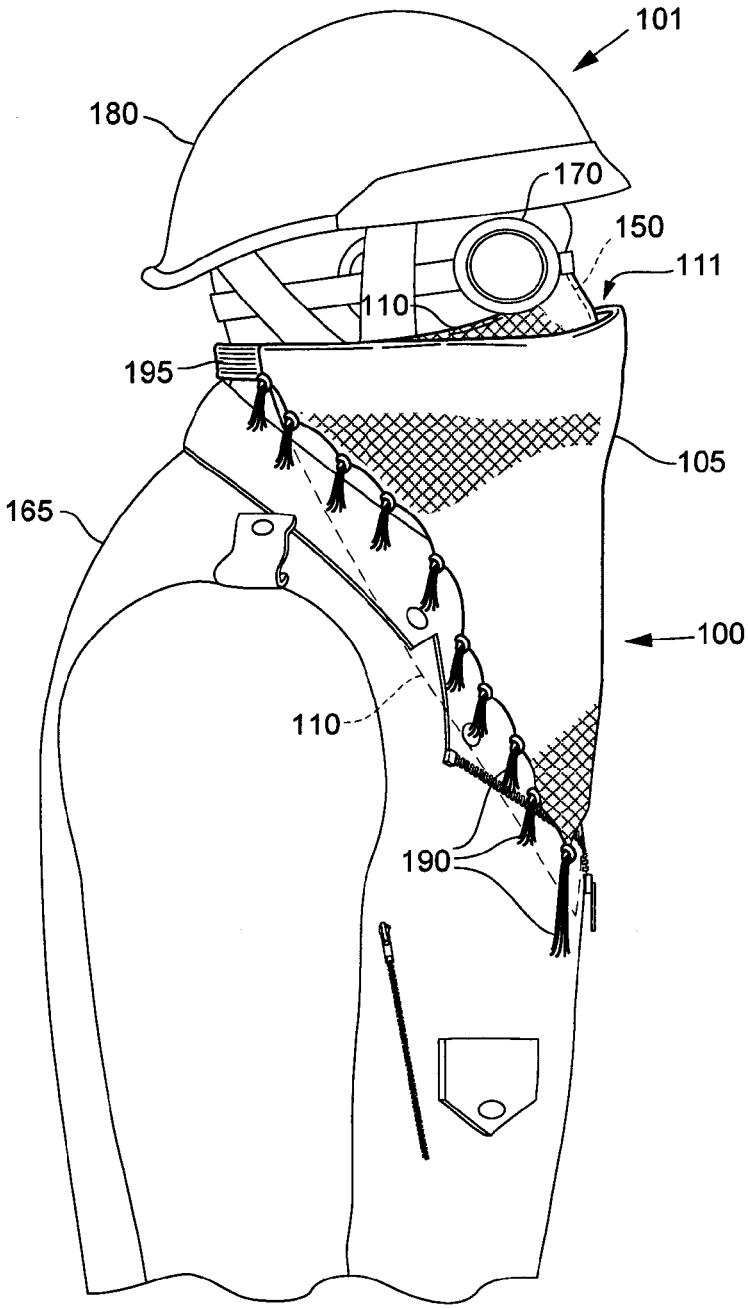
FIG. 4A is an illustration of a right side view of an embodiment of protective gear in accordance with the teaching of the invention herein, as may be disposed on a user.
Figure 4B:
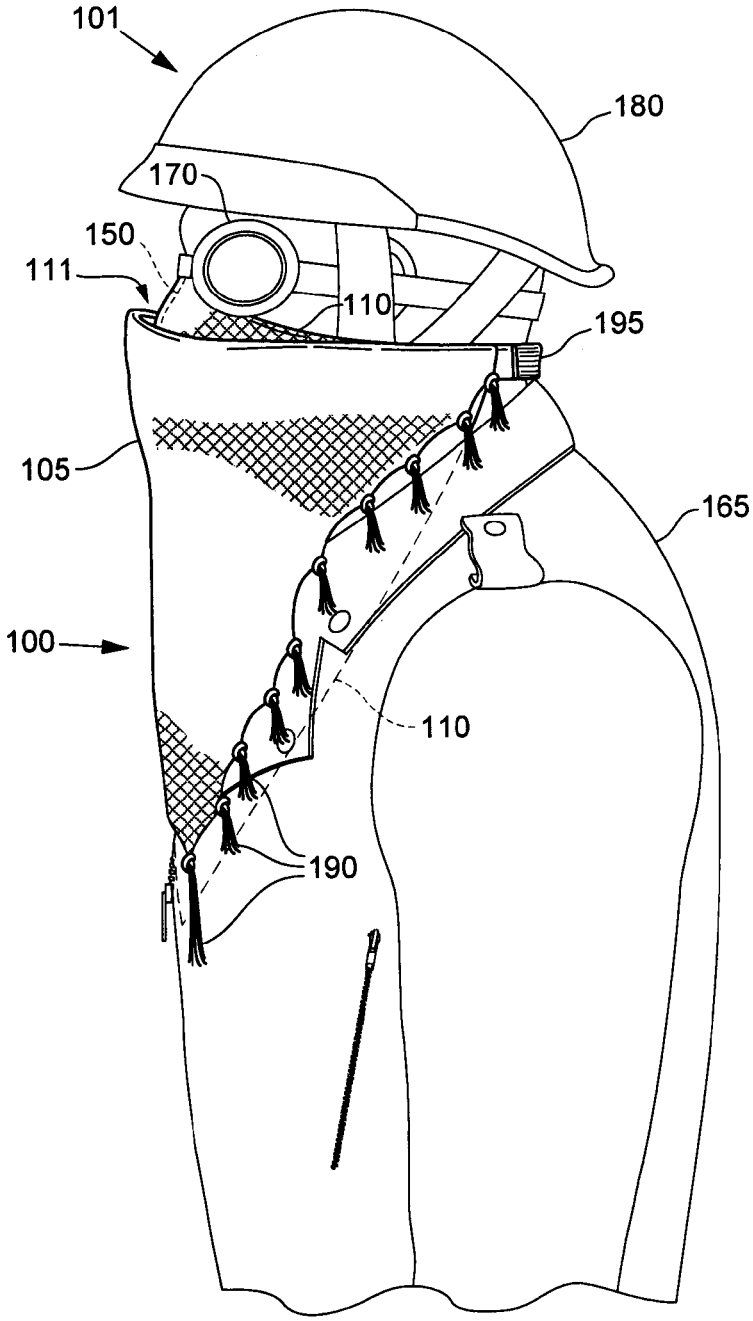
FIG. 4B is an illustration of a left side view of an embodiment of protective gear in accordance with the teaching of the invention herein, as may be disposed on a user.

FIG. 4A illustrates a right side view of an embodiment of gear 100, relative to FIG. 3, as maybe worn by user 101. Gear 100 is illustrated as being disposed such that inner panel 110 may be held in contact with a portion of user 101, with outer panel 105 being attached thereto, yet sized and shaped to provide a spatial separation therebetween. In FIG. 4A, the depicted embodiment of gear 100 can include inner panel 110, outer panel 105, a plurality of standoffs 190, and indexing element 195. Indexing element 195 provides user 101 with a tactile indication of fastener location. Indexing element 195 may be removably fixed in position, for example, generally behind and to the side of the head of user 101, and disposed in a manner allowing a user wearing thick, heavy-duty gloves, to perceive and easily manipulate indexing element 195. Such access and ease of manipulation may simplify the task of user 101 of quickly adjusting the fit of gear 100 around user 101, or of rapidly locating the place of attachment and remove gear 100 completely. FIG. 4B illustrates a left side view of an embodiment of gear 100, relative to FIG. 3A, as maybe worn by user 101. In FIG. 4B, the depicted embodiment of gear 100 can include inner panel 110, outer panel 105, a plurality of standoffs 190, and a portion of common tab with loop portion of fastener.

Embodiments of gear 100 are configured to be versatile protective clothing. For example, gear 100 also can be worn as a neckerchief for warmth in cold weather, yet it also may be configured to be not as hot or uncomfortably thick around the neck of user 101 during hot days as an ordinary shemagh may be. Gear 100 also can be easily donned or removed and may be more easily adjusted for use, even if user 101 may be wearing thick gloves.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as "comprising" (i.e., open language). The term "attached", as used herein, is defined as connected, although not necessarily directly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention, as defined by the appended claims.

What is claimed is:

1. A protective head gear for a user, comprising:

an outer panel having an outer obverse side and an outer reverse side, the outer panel having a outer base and an outer apex generally perpendicular to the base;

an inner panel having an inner obverse side and an inner reverse side, the inner panel having a inner base and an inner apex generally perpendicular to the inner base, wherein a portion of the outer base of the outer panel is partly attached to a corresponding portion of the inner base of the inner panel, leaving a portion of the periphery unattached;

wherein an efficacious spatial gap is formed when the portion of the outer base of the outer panel is at least partly attached to a corresponding portion of the inner base of the inner panel;

wherein a portion of the outer reverse side is proximate to a portion of the inner obverse side, wherein a spatial separation is disposed between the outer reverse side and the inner obverse side, a retention pleat formed in the inner panel at least in proximity with the inner base midpoint and positioned approximately distally to and in parallel with the inner apex, wherein the retention pleat is formed to retain a portion of the user; and a fastener attached to at least one end of one or both of the outer panel and the inner panel, wherein the fastener is formed to adjustably and releasably secure at least a portion of the inner panel to the user.

2. The protective head gear of claim 1, further comprising:

a respirator panel attached to an upper portion of the reverse side of the inner panel, approximately rearward of the retention pleat and approximately midpoint along the inner panel.

3. The protective head gear of claim 1, further comprising:

an indexing device affixed to an end of the obverse side of the outer panel, wherein the indexing device is adjustably and releasably affixed to a portion of the fastener.

4. The protective head gear of claim 2, further comprising:

an indexing device affixed to an end of the obverse side of the outer panel, wherein the indexing device is adjustably and releasably affixed to a portion of the fastener.

5. The protective head gear of claim 2, wherein the respirator panel further comprises:

a perforated cloth having an at least partly hydrophobic absorption characteristic.

6. The protective head gear of claim 5, wherein the obverse side of the outer panel further comprises:

an at least partly hydrophobic absorption characteristic.

7. The protective head gear of claim 3, further comprising:

a plurality of standoffs generally disposed upon the outer panel, and positioned to interpose, at least in part, between the outer panel and the inner panel, and to provide at least a partial spatial separation between a portion of the outer panel and a portion of the inner panel.

8. A protective head gear for a user, comprising:

an outer panel having an outer obverse side and an outer reverse side, the outer panel having an outer base and an outer apex generally perpendicular to the base;

an inner panel having an inner obverse side and an inner reverse side, the inner panel having an inner base and an inner apex generally perpendicular to the inner base, wherein a portion of the outer base of the outer panel is partly attached to a corresponding portion of the inner base of the inner panel, leaving a portion of the periphery unattached;

wherein an efficacious spatial gap is formed when the portion of the outer base of the outer panel is partly attached to a corresponding portion of the inner base of the inner panel;

wherein a portion of the outer reverse side is proximate to a portion of the inner obverse side, wherein a spatial separation is disposed between the outer reverse side and the inner obverse side, a retention pleat formed in the inner panel at least in proximity with the inner base midpoint and positioned approximately distally to and in parallel with the inner apex, wherein the retention pleat is formed to retain a portion of the user;

a fastener attached to at least one end of one or both of the outer panel and the inner panel, wherein the fastener is formed to adjustably and releasably secure at least a portion of the inner panel to the user;

a respirator panel attached to an upper portion of the reverse side of the inner panel, approximately rearward of the retention pleat and approximately midpoint along the inner panel;

an indexing device affixed to an end of the obverse side of the outer panel, wherein the indexing device is adjustably and releasably affixed to a portion of the fastener; and a plurality of standoffs generally disposed upon the outer panel, and positioned to interpose, at least in part, between the outer panel and the inner panel, and to provide at least a partial spatial separation between a portion of the outer panel and a portion of the inner panel.

* * * * *